US006490428B1

(12) United States Patent
Fromm et al.

(10) Patent No.: US 6,490,428 B1
(45) Date of Patent: Dec. 3, 2002

(54) STRIPPER FINGERS AND ASSOCIATED MOUNTS FOR A FUSER IN A PRINTING APPARATUS

(75) Inventors: Paul M. Fromm, Rochester, NY (US); Richard C. Benton, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/024,195

(22) Filed: Dec. 21, 2001

(51) Int. Cl.[7] ..... G03G 15/20
(52) U.S. Cl. ..... 399/323
(58) Field of Search ..... 399/323, 322, 399/399, 22; 271/311, 312, 313

(56) References Cited

U.S. PATENT DOCUMENTS

| | | | | |
|---|---|---|---|---|
| 4,062,534 A | | 12/1977 | Sasahara | 271/174 |
| 4,796,880 A | | 1/1989 | Tamary | 271/311 |
| 5,448,347 A | | 9/1995 | Mills | 355/315 |
| 5,589,925 A | * | 12/1996 | Cahill | 399/323 |
| 5,623,720 A | * | 4/1997 | Howe et al. | 399/323 |
| 5,822,668 A | | 10/1998 | Fromm et al. | 399/323 |
| 6,029,039 A | | 2/2000 | Aslam et al. | 399/323 |

* cited by examiner

*Primary Examiner*—Arthur T. Grimley
*Assistant Examiner*—Ryan Gleitz
(74) *Attorney, Agent, or Firm*—R. Hutter

(57) ABSTRACT

In a fuser for xerographic printing, stripper fingers remove the print sheet from a fuser roll. Each stripper finger is a thin member which is urged against the fuser roll with a spring force caused by deformation of the stripper finger against the roll. Each stripper finger is mounted on a mount which is itself springably urged against a stop, so that the spring force of the stripper finger is largely independent of the spring force associated with the mount. The arrangement enables design latitude in choosing spring forces associated with the stripper finger and the mount, and also enables the stripper fingers to be moved away from damaging contact with a mis-stripped sheet.

8 Claims, 3 Drawing Sheets

STRIPPER FINGERS AND ASSOCIATED MOUNTS FOR A FUSER IN A PRINTING APPARATUS

FIELD OF THE INVENTION

The present invention relates to stripper fingers and associated mounts used with a fuser, such as for xerographic printers.

BACKGROUND OF THE INVENTION

In xerographic or electrostatographic printers commonly in use today, a charge-retentive member is charged to a uniform potential and thereafter exposed to a light image of an original document to be reproduced. The exposure discharges the charge-retentive surface in exposed or background areas and creates an electrostatic latent image on the member which corresponds to the image areas contained within the original document. Subsequently, the electrostatic latent image on the charge-retentive surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the charge-retentive area to form a powder image on the charge-retentive area. This image is subsequently transferred to a sheet, such as copy paper, to which it is permanently affixed by heating or by the application of pressure. Following transfer of the toner image to the sheet, the charge-retentive member is cleaned of any residual toner that may remain thereon in preparation for the next imaging cycle.

One approach to fixing the toner image is by applying heat and pressure by passing the sheet containing the unfused toner images between a pair of opposed roller members at least one of which is internally heated. During this procedure, the temperature of the toner material is elevated to a temperature at which the toner material coalesces and becomes tacky. This heating causes the toner to flow to some extent into the fibers or pores of the sheet. Thereafter, as the toner material cools, solidification of the toner material causes the toner material to become bonded to the support member. Typical of such fusing devices are two roll systems wherein the fuser roll is coated with an adhesive material such as a silicone rubber or other low surface energy elastomers.

During the fusing process and despite the use of low surface energy materials as the fuser roll surface, there is a tendency for the print substrate to remain tacked to the fuser roll after passing through the nip between the fuser roll and the pressure roll. When this happens, the tacked print substrate does not follow the normal substrate path but rather continues in an arcuate path around the fuser roll, eventually resulting in a paper jam which will require operator involvement to remove the jammed paper before any subsequent imaging cycle can proceed. As a result it has been common practice to ensure that the print substrate is stripped from the fuser roll downstream of the fuser nip. One approach is the use of a plurality of stripper fingers placed in contact with the fuser roll to strip the print substrate from the fuser roll. While satisfactory in many respects, this suffers from difficulties with respect to both fuser roll life and print quality. To ensure an acceptable level of stripping it is frequently necessary to load such a stripper finger against the fuser roll with such a force and at such an attack angle that there is a tendency to peel the silicone rubber off the fuser roll, thereby damaging the roll to such an extent that it can no longer function as a fuser roll.

The present invention is directed to an improved design of a stripper finger and associated mounting structure.

DESCRIPTION OF THE PRIOR ART

U.S. Pat. No. 4,062,534 discloses a fusing apparatus in which a plurality of rigid stripping pawls are urged against a fuser roll. For each pawl, a spring directly urges the pawl against the roll.

U.S. Pat. No. 4,796,880 discloses a fusing apparatus in which a "skive" is used to strip sheets from the fuser roll. The skive is a metal plate which is urged against the roll by its own spring constant.

U.S. Pat. No. 5,448,347 discloses a mounting arrangement for a skive used to strip sheets from a fuser roll. The skive is mounted on a flexible mounting, and further defines a guide surface for directing the stripped sheet along a post-fuser path.

U.S. Pat. No. 5,822,668 discloses a fuser module which pivots open for jam clearance. Rigid stripper fingers are urged against the fuser roll. When the module is pivoted open, the stripper fingers disengage from the fuser roll and land on a stop within the module. As the module is re-closed, contours associated with the stripper finger follow the stop so that the stripper finger is properly set back on the fuser roll without spiking the fuser roll.

U.S. Pat. No. 6,029,039 discloses a retractable skive assembly. Each rigid skive is urged against a surface of the fuser roll by a spring. The skive and spring are mounted on a retractor which disengages the skive from the roll for manual paper jam clearance.

It is known in the prior art to mount flexible stripper fingers rigidly within a machine, so that the fingers are urged against a fuser roll exclusively by the spring force caused by deformation of the fingers.

SUMMARY OF THE INVENTION

According to one aspect of the present invention, there is provided a fusing apparatus useful in printing, comprising a fuser roll; a first stripper finger mount; spring means for urging the first stripper finger mount substantially toward the fuser roll and against a stop; and a first stripper finger mounted on the first stripper finger mount, the stripper finger contacting the fuser roll with a spring force when the first stripper finger mount is urged against the stop.

DETAILED DESCRIPTION OF THE INVENTION

Figure 1:
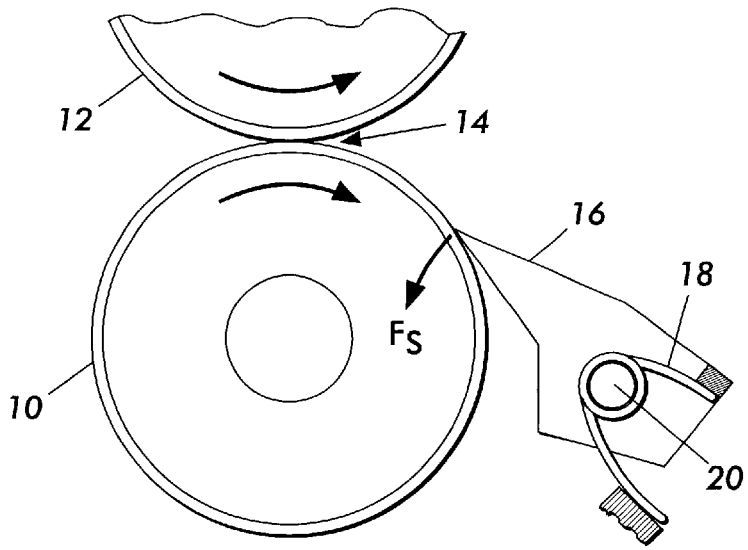
FIG. 1 PRIOR ART
FIG. 1 is an elevational view of a stripper finger according to the prior art, interacting with a fuser roll.

FIG. 1 is an elevational view of a stripper finger assembly as known in the prior art, and as such is similar in general design to the stripper fingers shown in U.S. Pat. Nos. 4,062,534 and 5,822,668 referenced above. Typical in any xerographic fusing apparatus is a fuser roll, here indicated as 10, which contacts a pressure roll 12 along a longitude thereof, forming a nip 14 therebetween. As is familiar in the art, print sheets, such as created by xerographic printing, are pulled through the nip by the rotation of rolls 10, 12. Typically the freshly-fused marking material, such as toner, on the print sheet, which is facing down in the view of FIG. 1, may cause the sheet to stick to the surface of fuser roll 10 even after passing through nip 14. To remove the sheet from the surface of fuser roll 10 as the sheet is drawn through nip 14, it is typical to use one or more springably-urged stripper fingers such as 16. Each stripper finger 16 contacts the fuser roll 10 near nip 14 and functions to lift sheets off the roll 10 as the sheet passes thereover.

According to the particular prior-art example shown in FIG. 1, a stripper finger 16 is a substantially rigid member, having by itself essentially no spring constant associated therewith. The spring force $F_S$ with which stripper finger 16 is urged against the roll 10 is provided exclusively by a spring 18 (which is here in the form of a torsion spring, but could be in other forms as well). The stripper finger 16 is thus rotatably mounted on axle 20.

Selection of a value of $F_S$, which basically relates to a spring constant associated with spring 18, for satisfactory performance must balance at least two competing interests. Very generally, a higher force $F_S$ will be more effective in peeling off the sticking sheet from the surface of roll 10. However, too high a force $F_S$ can damage the surface of roll 10, and thus selection of a value of $F_S$ would be intimately related to, for instance, the deformability and therefore the material selection of roll 10. Also, a lighter force $F_S$ will be more effective in allowing the stripper finger 16 to rotate around axle 20 away from the roll 10 in case of a paper jam around stripper finger 16. Often an optimal $F_S$ for purposes of efficient stripping will be at cross-purposes with a value of $F_S$ for jam clearance and avoidance.

Figure 2:
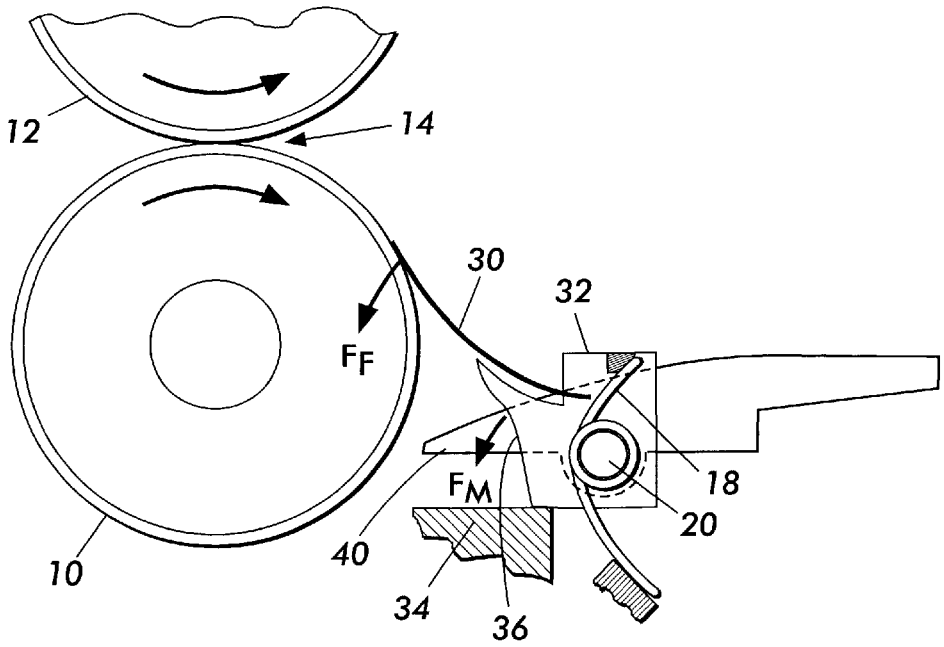
FIGS. 2–4 are a series of elevational views of a stripper finger and associated mount according to the present invention, each view showing the mount in a particular position relative to a fuser roll.

FIG. 2 is an elevational view of an embodiment of a stripper finger assembly according to the present invention. The embodiment differs from the prior-art example above in that, instead of having a unitary, rigid stripper finger mounted on axle 20, a stripper finger 30 is connected to what is here called a "mount" 32. The stripper finger 30 in this embodiment is a deformable member, typically substantially made of stainless steel, which exhibits a spring constant yielding a force $F_F$ when it is placed in contact with roll 10 and is thus slightly deformed. Mount 32, in turn, is rotatably mounted on axle 20, and is urged with a force $F_M$ generally toward roll 10 by (in this case) a torsion spring 18, much in the manner of the rigid stripper finger in FIG. 1 above. However, mount 32 is urged not against roll 10, but rather against a stop 34 (herein, a "stop" can be any available restricting surface). In the illustrated embodiment, therefore, the only force against roll 10 is the force $F_F$ exerted by the deformation of stripper finger 30; the force $F_M$ ultimately exerted by spring 18 is stopped by stop 34.

Figure 5:
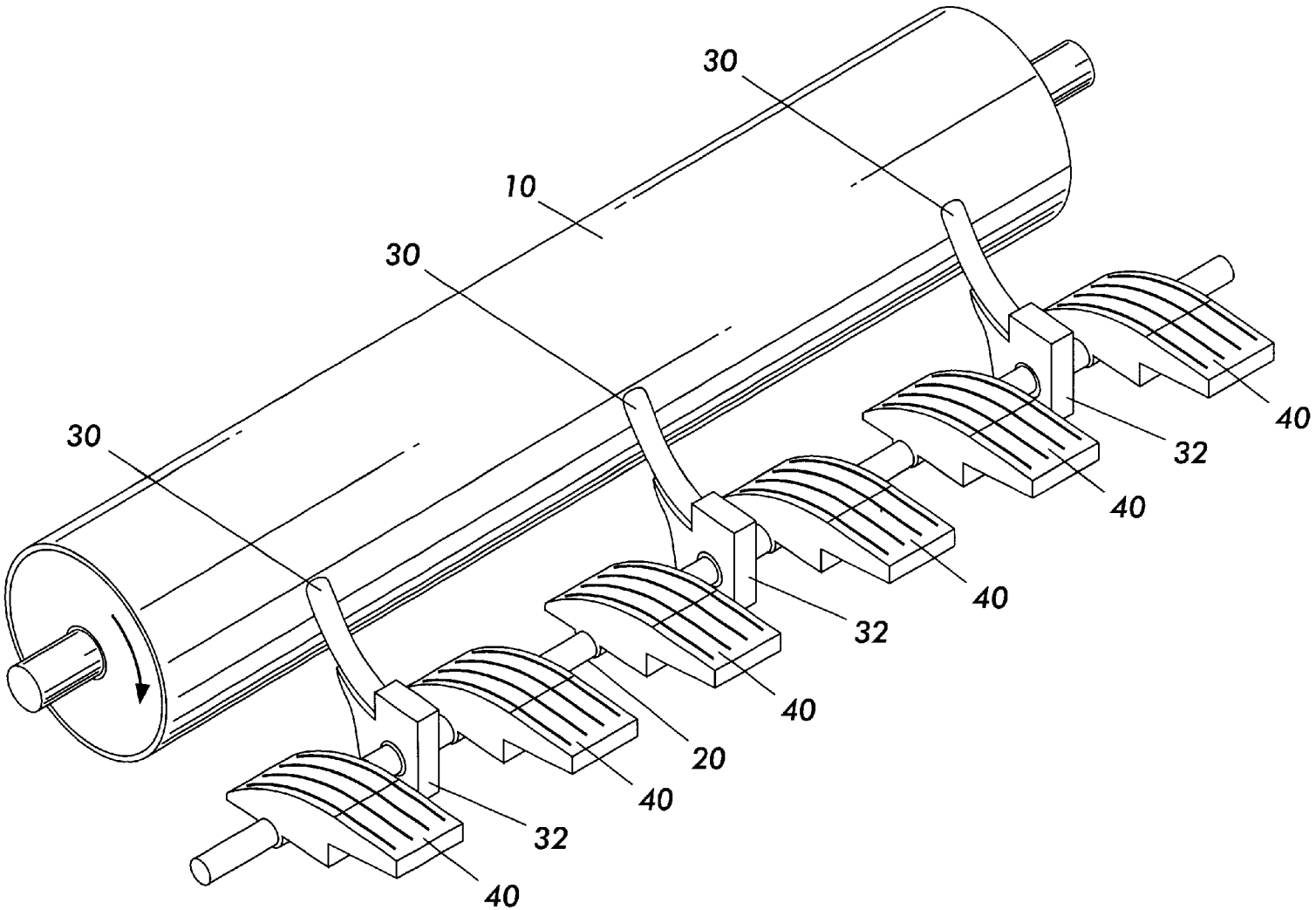
FIG. 5 is a perspective view of an assembly of stripper fingers, according to the present invention.

FIG. 5 is a perspective view of an assembly including a plurality of stripper fingers 30 and associated mounts 32, as in FIG. 2. In one embodiment, each of a plurality of such mounts 32 along a roll 10 are movable independently of each other. As can be seen, there is further provided, on either side of (or, more broadly, adjacent to) each mount 32, what is here called a "baffle" and which is indicated in as 40. The baffles 40 provide surfaces against which mis-stripped papers crumple, as will be explained below.

Figure 3:
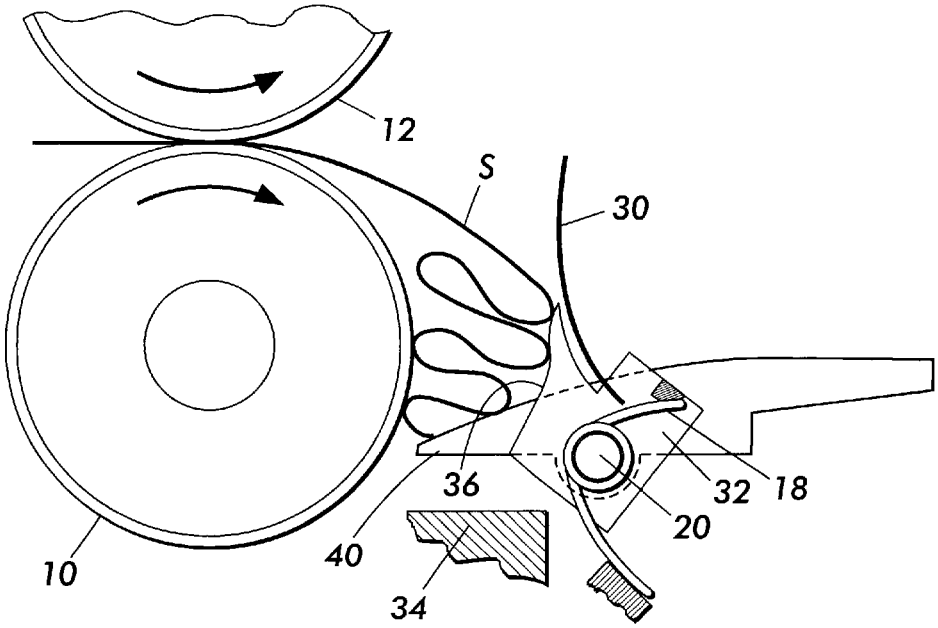

The arrangement of FIG. 2 thus enables greater design latitude than the example of FIG. 1. The value of $F_F$ can be selected for purposes of stripping efficiency, while the value of $F_M$ can be selected for purposes of jam clearance and protection of the finger 30. FIG. 3 shows the behavior of the FIG. 2 arrangement in a worst-case scenario, a mis-strip where, instead of being stripped off roll 10 by stripper finger 30, the lead edge of a sheet S passes under the stripper finger 30 and is thus caused to crumple against the baffle 40 and under the mount 32. The crumpling of the sheet against mount 32 and baffle 40 causes mount 32 to be pushed away from roll 10, providing more "crumple zone" room in which the sheet S can crumple: compression of a crumpling sheet within a small volume is likely to damage hardware surrounding the sheet. The swinging away of mount 32 also serves to take stripper finger 30 away from the crumple zone, where it may be damaged. The mount 32 may also define a contoured surface, here a specially curved surface 36, which is designed to guide the mis-stripped sheet so that it is likely to push away mount 32 in the event of the sheet crumpling under mount 32.

Figure 4:
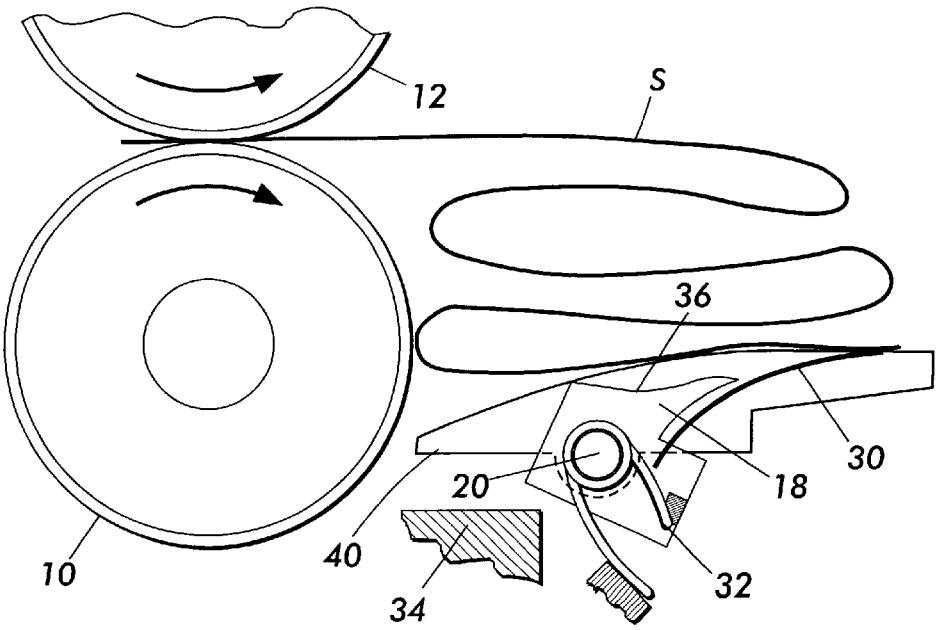

FIG. 4 shows a further capability of one embodiment of the invention, in which each mount 32 is capable of rotating around axle 20 by a large angle, such as 90 degrees or greater relative to its position against stop 34. As shown, a mis-strip of a sheet S pushes mount 32 around a large angle. The stripper finger 30 is thus disposed below the top surface of baffle 40, and in effect hidden by the baffle 40 from contact with any crumpling sheets.

While the invention has been described with reference to the structure disclosed, it is not confined to the details set forth, but is intended to cover such modifications or changes as may come within the scope of the following claims.

What is claimed is:

1. A fusing apparatus useful in printing, comprising:

a fuser roll;

a first stripper finger mount;

spring means for urging the first stripper finger mount substantially toward the fuser roll and against a stop;

a first stripper finger mounted on the first stripper finger mount, the stripper finger contacting the fuser roll with a spring force when the first stripper finger mount is urged against the stop;

a baffle, the baffle defining a surface adjacent the first stripper finger along a length of the roll when the first stripper finger is contacting the fuser roll, the baffle aiding in causing a sheet crumpling between the roll and the mount to move the mount away from the roll; and wherein the mount is rotatable to a position where the first stripper finger is effectively hidden by the baffle and the sheet crumpling between the roll and the mount is guided by the baffle away from the fuser roll.

2. The apparatus of claim 1, wherein the spring force of the first stripper finger is created by a deformation of the first stripper finger against the roll.

3. The apparatus of claim 2, wherein the spring force of the first stripper finger is created exclusively by a deformation of the first stripper finger against the roll.

4. The apparatus of claim 1, the mount defining a contour surface, the contour surface aiding in causing a sheet crumpling between the roll and the mount to move the mount away from the roll.

5. The apparatus of claim 1, wherein the mount is rotatable through at least 90 degrees.

6. The apparatus of claim 1, wherein the roll is a fuser roll for fusing an image formed by electrostatographic printing.

7. The apparatus of claim 1, further comprising a second stripper finger mount;

spring means for urging the second stripper finger mount substantially toward the fuser roll and against the stop;

a second stripper finger mounted on the second stripper finger mount, the stripper finger contacting the fuser roll with a spring force when the first stripper finger mount is urged against the stop.

8. The apparatus of claim 7, the first stripper finger mount and the second stripper finger mount being movable independently of each other.

* * * * *